United States Patent [19]

Pepe

[11] 3,935,908

[45] Feb. 3, 1976

[54] PILE HAMMERS

[76] Inventor: Charles R. Pepe, Old Quarry Road, Alpine, N.J. 07620

[22] Filed: Aug. 7, 1974

[21] Appl. No.: 495,381

Related U.S. Application Data

[63] Continuation-in-part of Ser. No. 251,785, May 9, 1972, Pat. No. 3,838,741.

[52] U.S. Cl. ..... 173/127; 91/234

[51] Int. Cl.[2] ..... E02D 7/10

[58] Field of Search ..... 173/127, 128, 134–138; 91/234, 233

[56] References Cited

UNITED STATES PATENTS

| | | | |
|---|---|---|---|
| 1,264,318 | 4/1918 | McGrath | 173/136 X |
| 1,601,733 | 10/1926 | Gilman | 91/234 X |
| 2,345,563 | 4/1944 | Alcorn | 91/233 |
| 2,820,433 | 1/1958 | Pyk | 173/127 |

*Primary Examiner*—Ernest R. Purser
*Attorney, Agent, or Firm*—Samuelson & Jacob

[57] ABSTRACT

Power hammers for driving piling, and the like, free of any complex valve mechanism likely to require attention and comprising a working cylinder having an anvil at the lower end thereof and a ram operative as a piston in the cylinder, cooperative with the anvil and surrounding walls of the cylinder to form an expansion chamber, the ram having a passage extending from an annular groove intermediate the ends of the ram, down through the lower end to the expansion chamber and the cylinder having pressure supply and exhaust ports to register with the passage and to be uncovered by the ram, in lower and upper positions of the ram in the cylinder, whereby the essential functions of the hammer are automatically effected in the normal operation of the ram. Pressure controlled valves may be added to automatically hold desired pressures and release opposing pressures on the ram.

6 Claims, 24 Drawing Figures

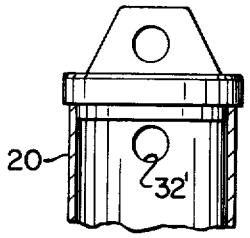
FIG. 1A
FIG. 3
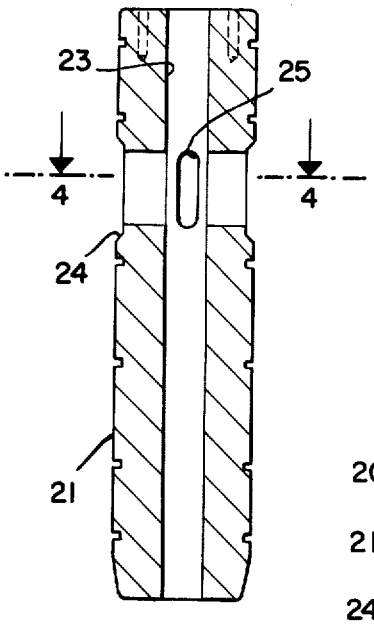
FIG. 2
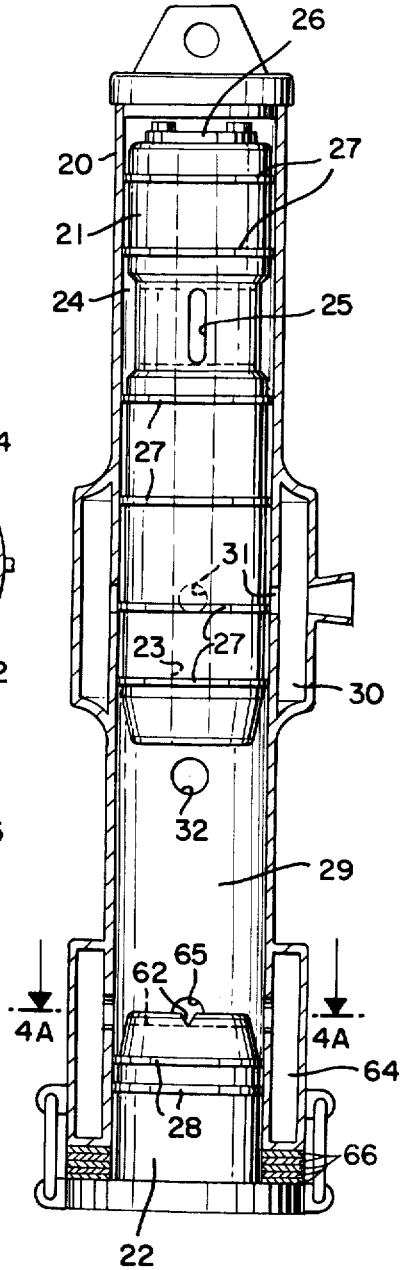
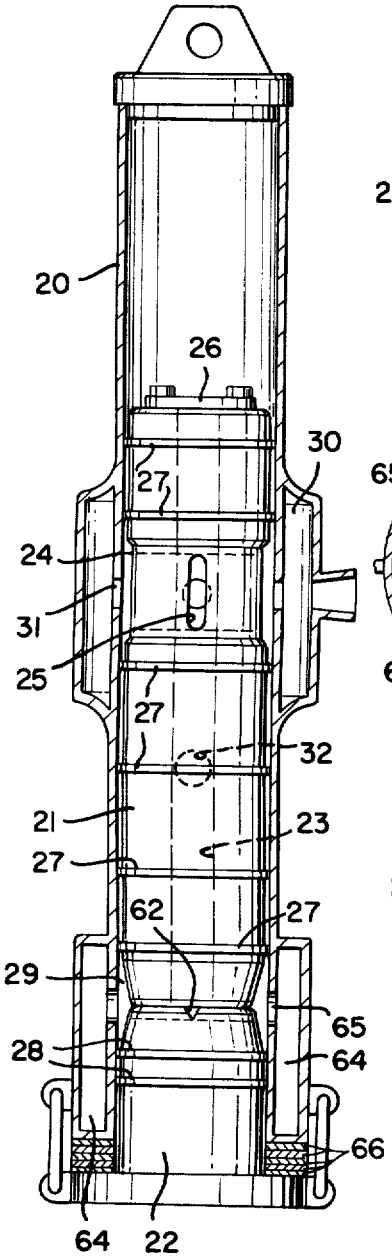
FIG. 1
FIG. 4A
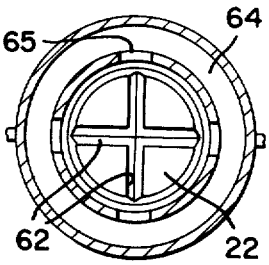
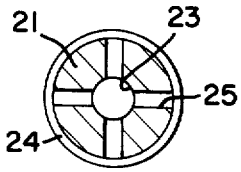
FIG. 4

FIG.7
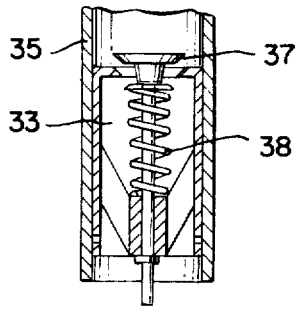
FIG.5
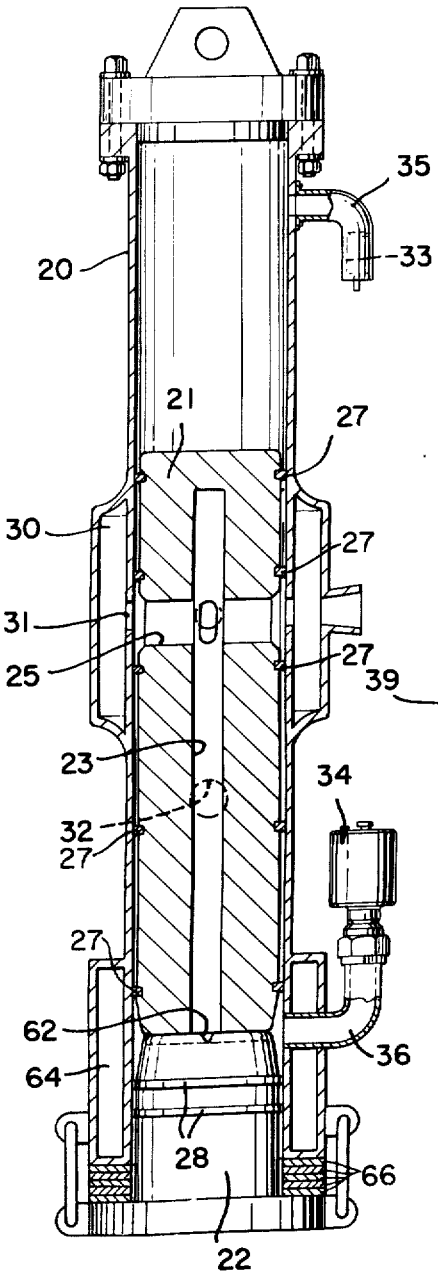
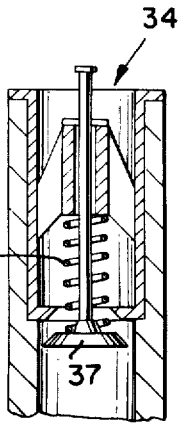
FIG.8
FIG.6
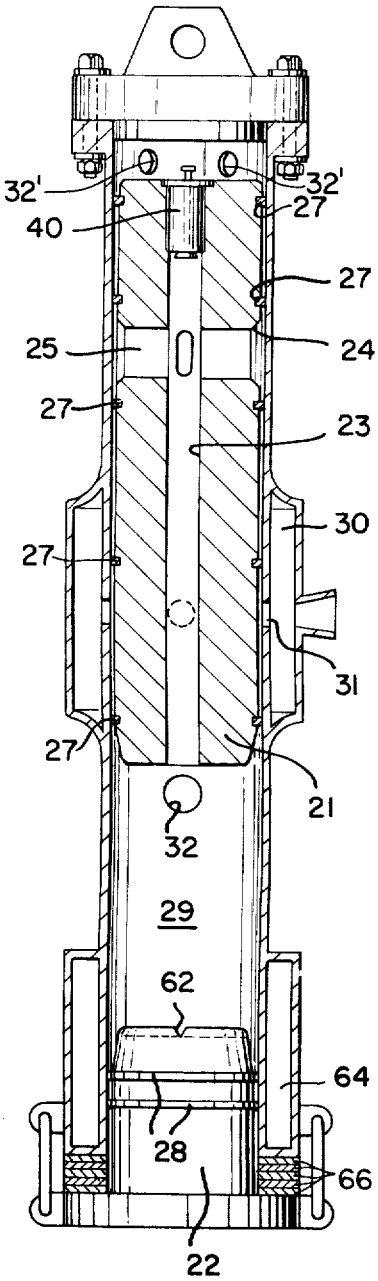

FIG. 11
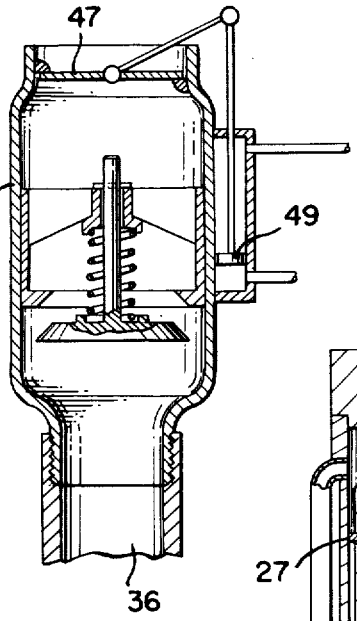
FIG. 12
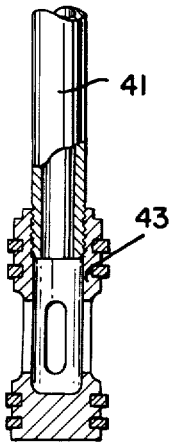
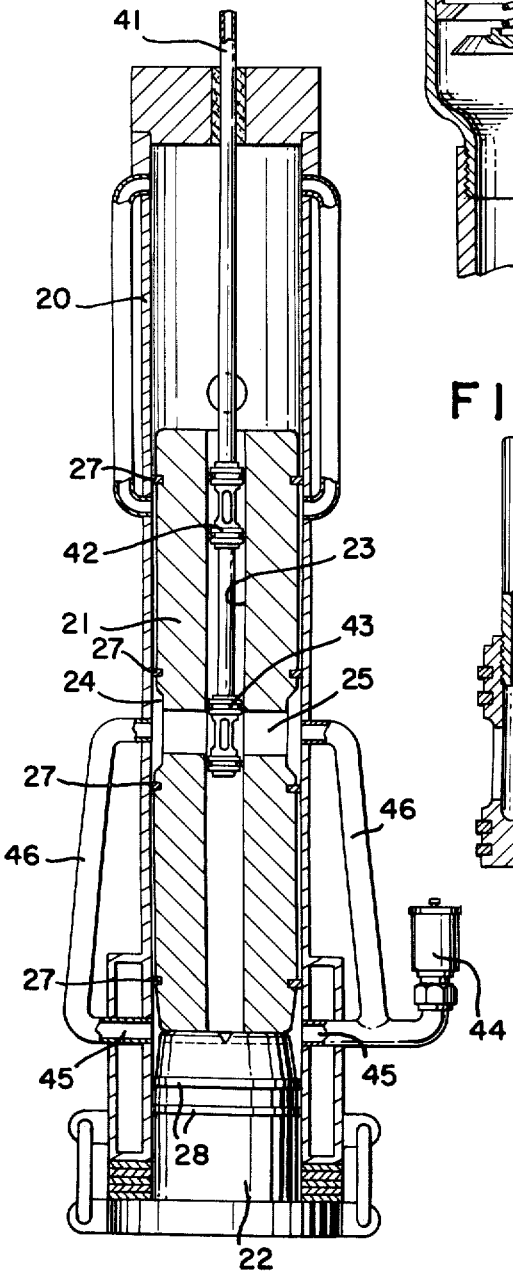
FIG. 9
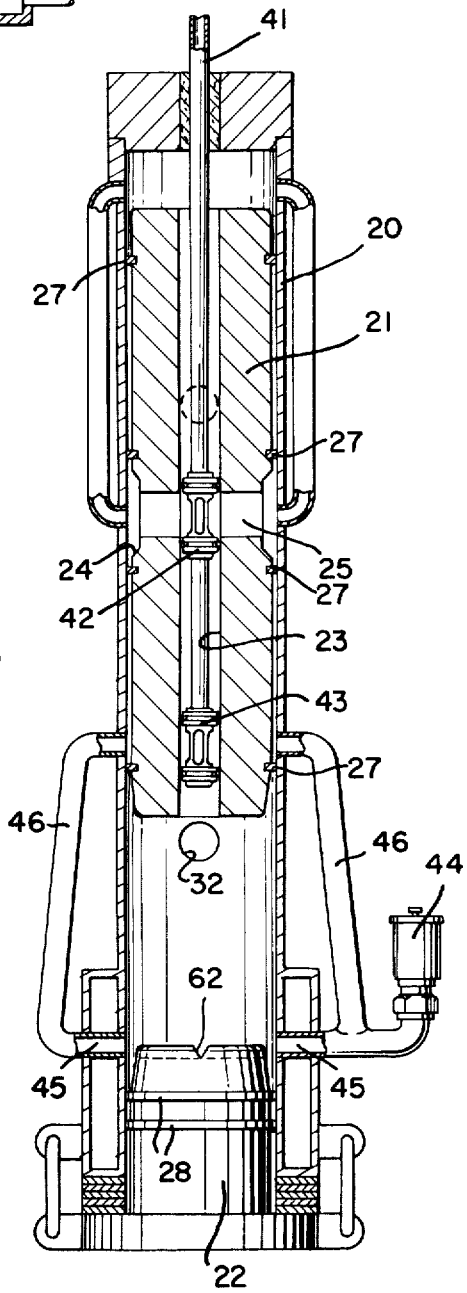
FIG. 10

PILE HAMMERS

This is a continuation-in-part of my earlier copending application, Ser. No. 251,785, filed May 9, 1972, now U.S. Pat. No. 3,838,741, dated Oct. 1, 1974 and entitled "Pile Hammers".

The present invention relates generally to power hammers and pertains, more specifically, to power hammers for driving piling and known as pile hammers.

Generally stated, objects of the invention are to provide a pile hammer of simple, sturdy construction, which could be produced at reasonably low cost, which would have greater power output and speed of action than pile hammers of conventional design, which would be controllable to meet existing operating conditions, and which would be practical in all respects.

The accompanying drawing illustrates certain present practical embodiments of the invention, but the structure may be further modified and changed, as regards to the immediate illustration, all within the true intent and scope of the invention, as hereinafter defined and claimed. In the drawing:

FIG. 1 is a longitudinal cross-sectional view of one of the pile hammers constructed in accordance with the invention, with the ram shown at the bottom of its stroke, in engagement with the anvil and closing the exhaust port in the side of the cylinder;

FIG. 1A is a fragmentary view of the upper portion of an alternate cylinder construction;

FIG. 2 is a view similar to FIG. 1, but showing the ram at the top of its stroke, in position opening the exhaust port;

FIG. 3 is a longitudinal cross-sectional view of the ram;

FIG. 4 is a cross-sectional view of the ram taken along line 4—4 of FIG. 3;

FIG. 4A is a cross-sectional view taken along line 4A—4A of FIG. 2;

FIG. 5 is a cross-sectional view similar to FIG. 1, showing automatic pressure control valves added at opposite ends of the cylinder;

FIG. 6 is a like cross-sectional view showing a pressure control valve seated in the upper end of the ram;

FIGS. 7 and 8 are enlarged fragmentary cross-sectional views of the upper and lower control valves shown in FIG. 5;

FIGS. 9 and 10 are cross-sectional views illustrating a "double-acting" pile hammer constructed in accordance with the invention;

FIG. 11 is a cross-sectional detail of a "choke" form of pressure control;

FIG. 12 is an enlarged cross-sectional detail of the piston valve appearing in FIGS. 9 and 10;

Figure 13:
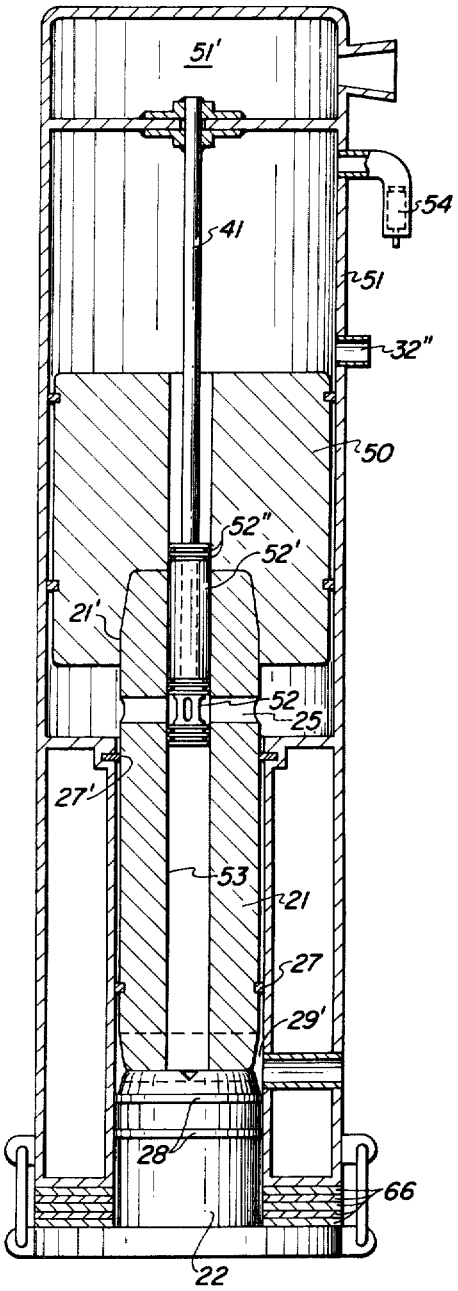
FIGS. 13 and 14 are cross-sectional views of a "compound" pile hammer constructed in accordance with the invention.

FIGS. 1 to 4 show a pile hammer constructed in accordance with the invention and including a working cylinder 20 of uniform diameter, and a companion uniform diameter ram 21, operating as a piston therein, in cooperative relation with an anvil 22, closing the lower end of the cylinder.

The ram is specially designed to operate as a valve maintaining the essential functions or phases of the pile hammer. Thus, the ram is shown as having a central bore or passage 23, extending from the top, down through the bottom of the ram and a shallow annular groove 24, in the side of the ram, intermediate the ends thereof, in communication with the bore, by equally spaced radial ports 25. The bore may be a central or off-center passage, functioning as it does, as a conduit for the motive fluid which usually is steam or compressed air. The ram is shown in FIGS. 1 and 2, closed at the top by a cover plate 26. The ram and the anvil are sealed in the cylinder, as by piston rings, indicated at 27 and 28, forming cooperatively an expansion chamber 29, beneath the lower face of the ram.

Motive fluid is supplied under pressure from a chest 30, surrounding the cylinder, having a plurality of equally spaced ports 31, in the cylinder, placed to register with the groove in the side of the ram, when the ram is at or about the lower end of its stroke. An exhaust port 32, in the side of the cylinder, is positioned to be covered by the ram in the lower portion of its stroke, as indicated in FIG. 1.

In operation, motive fluid passes from supply chest 30, through ports 31, into the groove 24 in the ram, with the ram in the lower portion of its stroke, and thence through radial ports 25, into the passage 23, to the expansion chamber 29 beneath the ram, so as to raise the ram. Cutoff is determined by passage of the grooved portion of the ram above the inlet ports 31, as in FIG. 2, and exhaust is effected when the sealed lower end portion of the ram over-reaches the exhaust port 32 in the cylinder.

In the variation illustrated in FIG. 1A, upward movement of the ram is facilitated by ports 32' which are open to the ambient atmosphere and relieve any back pressure in the upper portion of the cylinder as the ram rises. These same ports 32' will prevent vacuum buildup and consequent retardation of the ram during the downstroke thereof.

In FIG. 5, the hammer is shown equipped with pressure-operated automatic valves 33 and 34, with connections 35, 36 to opposite ends of the cylinder. These valves are alike in that they are each spring-opened and pressure-closed. Thus the upper, upwardly faced valve 33, as shown in detail in FIG. 7, is in the nature of a one-way check valve or poppet valve, having a conical valve member or element 37, held seated in closing position by pressure in the cylinder connection 35 and sustained in open relation by spring 38.

The upper valve, shown in FIG. 7, will thus stand open to atmosphere on down travel of the ram to prevent vacuum buildup and retarding effect on downstroke of the ram and will remain thus open until pressure generated on return stroke of the ram becomes sufficient to overcome the valve-opening spring force. This vacuum relief valve thus promotes full live action of the ram and buildup of a cushion and pressure source at start of the downstroke.

The lower valve 34, as shown in FIG. 8, opens downwardly, with the spring 39 holding it open to atmosphere to relieve back pressure on the downstroke of the ram. When sufficient pressure builds up beneath the ram, this valve closes, in readiness for the next upstroke of the ram. The release of pressure, upon opening of exhaust port 32, enables opening of the back pressure relief valve, as shown in FIG. 8, in proper timed sequence. These control valves facilitate and contribute to the full power development and speed of the hammer.

FIG. 6 shows how an automatic back pressure relief valve 40, similar to that shown in FIG. 8, may be incorporated in the head of the ram, seated in the upper end of the bore 23, left open in this case to receive the valve. Valve 40 closes upwardly by pressure admitted to the bore at start of the upstroke of the ram and opens to atmosphere to relieve back pressure on downstroke.

In the double-acting form of the hammer shown in FIGS. 9 and 10, a tube provides a valve inlet stem 41 and is supported in the head of the cylinder, stem 41 carrying piston valve elements 42, 43 spaced to register with the feed groove 24 in the ram, in the down (FIG. 9) and up (FIG. 10) positions of the ram. A back pressure relief valve 44, similar to that shown in FIG. 8, is provided in motive fluid connections 45, 46 to the lower portions of the cylinder. Thus, motive fluid enters stem 41 and passes through lower valve element 43 (also see FIG. 12) and motive fluid connections 45, 46 to the lower portion of the cylinder to raise the ram from the lower position, seen in FIG. 9, to the upper position, seen in FIG. 10. In the upper position, passage 23 of the ram seals the lower valve element 43 and motive fluid passes through upper valve element 42 and into the upper portions of the cylinder to drive the ram downward.

FIG. 11 shows how a pivoted choke 47 may be incorporated in a control valve 48, which is otherwise similar to that shown in FIG. 8, with a remote control operating piston 49. The purpose of this choke is to retard or vary energy output by increasing back pressure.

Figure 14A:
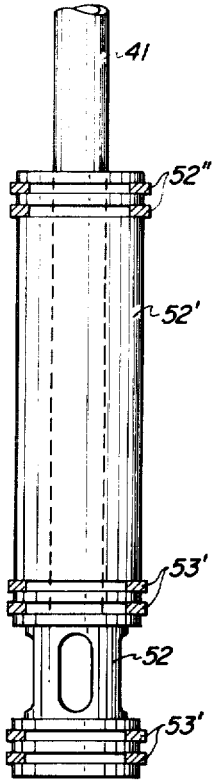
FIG. 14A is an enlarged detail of a control valve in the hammer of FIGS. 13 and 14.
Figure 14:
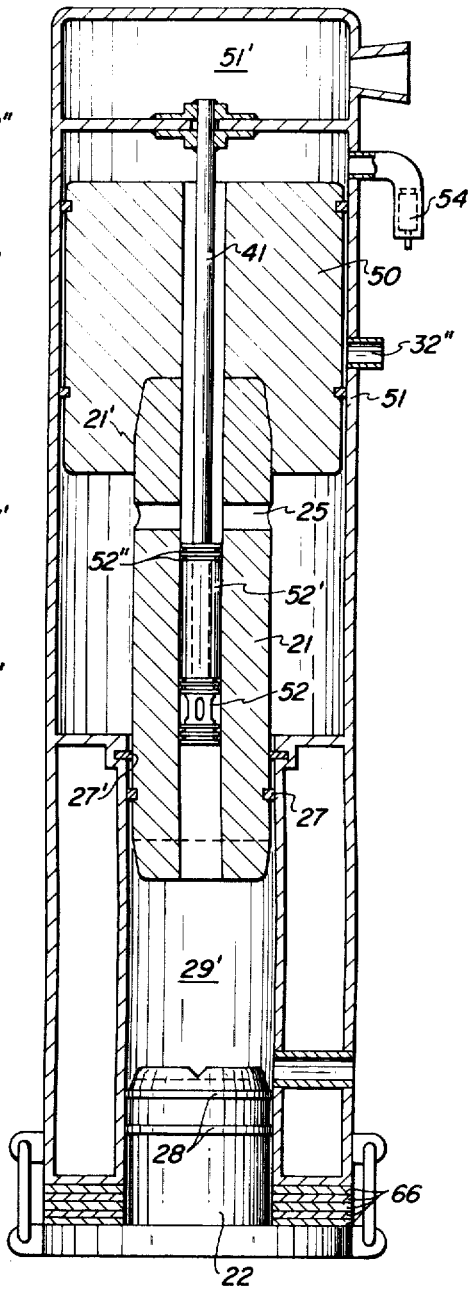

In the compound type of hammer shown in FIGS. 13 and 14, the ram 21 carries a larger diameter piston head 50 operating in a larger diameter cylinder extension 51. A control valve element 52 (also see FIG. 14A) is placed in the longitudinal passage 53 between opposite ends of the combined ram and piston head 50 and a valve 54, similar to that shown in FIG. 7, is connected with the upper end of the upper cylinder 51. Motive fluid passes from the chest 51' at the top of the cylinder extension 51 through tubular stem 41, valve element 52 and lateral ports 25 into the cylinder extension beneath piston head 50 to raise the piston head and the ram from the lower position, shown in FIG. 13, to the upper position, shown in FIG. 14. At the upper position, the valve element 52 is closed, but the partially expanded motive fluid passes from beneath the piston head 50 through the passage 53 into the cylinder extension above the piston head 50 to drive the piston head and ram downward. Valve 54 remains open by virtue of spring pressure during the upstroke and then closes, in response to the pressure of the motive fluid, for the downstroke. The valve element 52 has an extended sleeve 52' and sealing rings 52'' which close and seal the passage 53 to the passage of motive fluid from beneath the piston head 50 to above the piston head until the upstroke is nearly completed. Sealing rings 53' seal the motive fluid from passage 53.

It is noted that the higher pressure motive fluid beneath the piston head 50 acts upon the smaller annular area of the piston head between the ram and the cylinder, while the lower pressure, partially expanded motive fluid acts upon the larger area of the top of the piston head. In this manner full advantage is taken of the ability of the motive fluid to expand as much as possible. Upon completion of the downstroke, the motive fluid is exhausted through port 32'' and the cycle can be repeated. The location of chest 51' immediately above cylinder extension 51 enables heat from a heated motive fluid to maintain the cylinder extension at a higher temperature. The cylinderical portion 29' within which the striking portion of ram 21 operates is isolated from the working cylinder extension 51 by piston rings 27 and 27', thereby enabling simplification of the design of the anvil area. The two-part ram 21 and head 50 enables economical manufacture, utilizing appropriate materials for each part. Thus, the head 50 can be fabricated of inexpensive cast metal while the smaller ram 21 can be made of high quality steel for withstanding the necessary striking forces. The separate parts are then joined into an integral ram, as by a press-fit at 21'.

Figure 15:
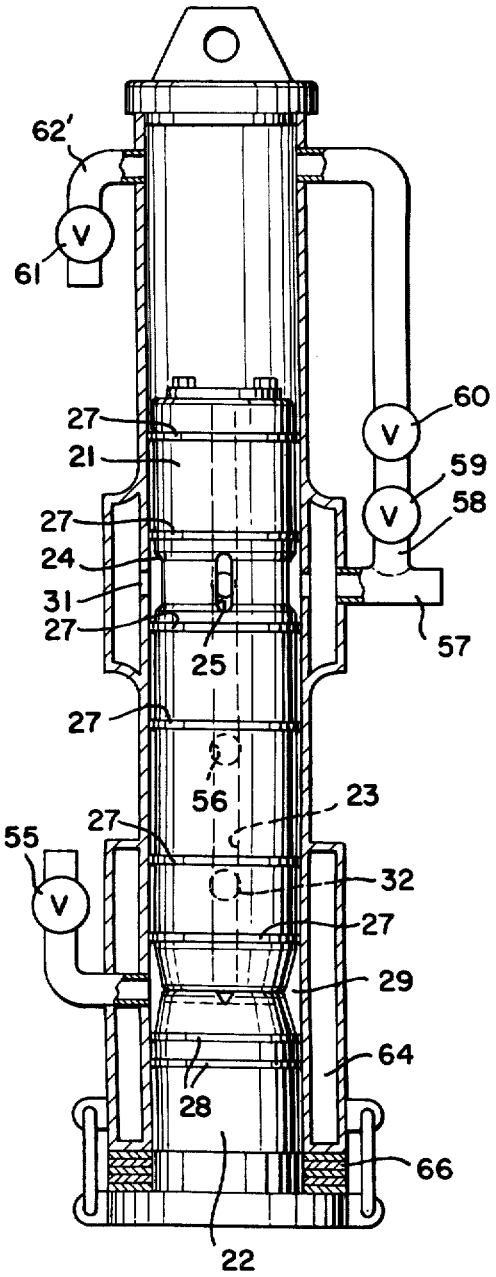
FIGS. 15 and 16 are longitudinal cross-sectional views of a convertible form of the pile hammer, designed to operate, for example, as a single action, 36 inch stroke, 80 blows per minute hammer, or as a double-acting 18 inch stroke, 100 blows per minute hammer.
Figure 16:
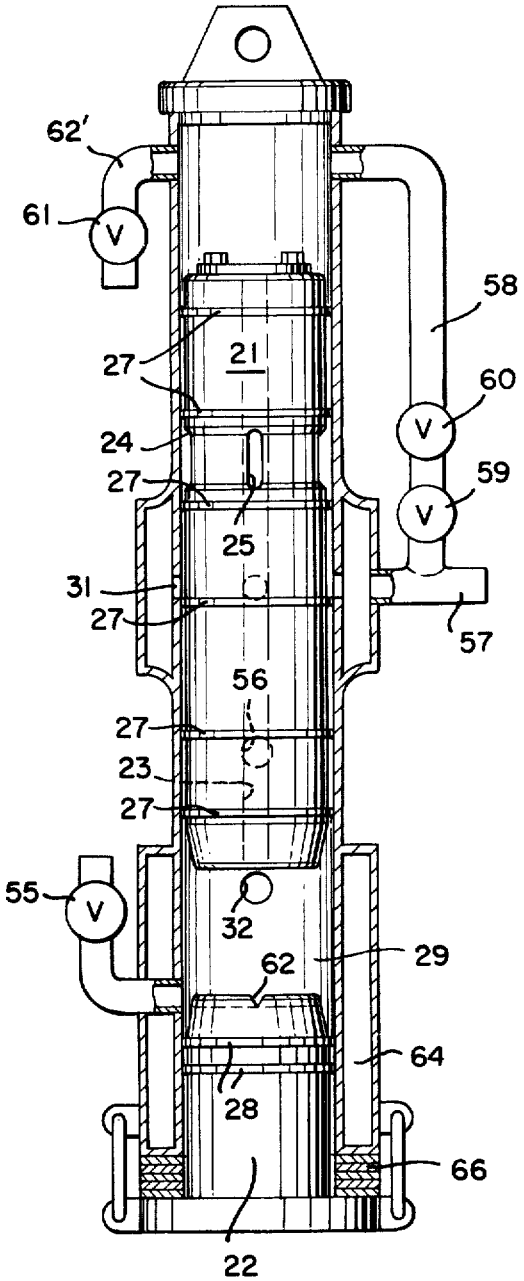

FIGS. 15 and 16 show how the hammer may be built in a "convertible" form, to operate as a single-acting, slower and longer stroke hammer, or as a double-acting, faster and shorter stroke hammer.

A spring-loaded, normally open control valve 55, similar to that in FIG. 8, is connected with the expansion chamber 29 and a second exhaust port 56 is spaced above the first exhaust port 32, to be uncovered in the longer stroke operation of the ram.

The pressure supply line 57 is branched at 58 into the top of the cylinder above the ram and is provided with a pressure-regulating valve 59 and with an on and off ball valve or equivalent control 60 above valve 59. An upper cylinder vacuum relief valve 61, similar to that in FIG. 7, is connected into the upper end of the cylinder at 62'.

The lower short-stroke exhaust port 32 may be closed by insertion of a plug, or by closing off the port with a valve, when operating as a slower, longer stroke hammer, with the ball valve closed and using the upper exhaust port 56.

The convertible form of the hammer provides an extensive choice of speeds and energy output. Without an upper cylinder compression and vacuum relief valve 61, the hammer may operate, for example, with a 4-foot stroke and a speed of 50 to 55 blows per minute. With an upper cylinder compression holder and vacuum relief valve 61 in place, this hammer may, in the example, be run at a speed of 80 blows per minute on a 3-foot stroke, in the single-acting mode.

With the lower exhaust port 32 open to atmosphere, the ball valve open, inlet pressure at 100 psi, and a constant down pressure on the upper face of the ram reduced by regulating valve 59 to, say, 40 psi, the hammer will operate with an 18 inch stroke, at 100 blows per minute.

Figure 17:
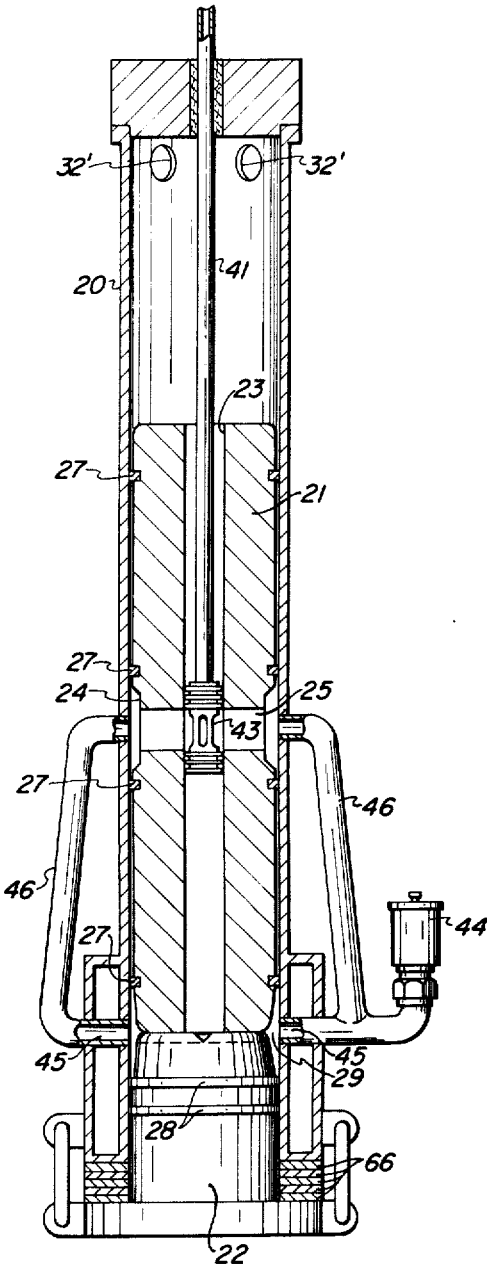
FIGS. 17 and 18 are longitudinal cross-sectional views of a "single-acting" pile hammer employing a control valve in the passage of the ram.
Figure 18:
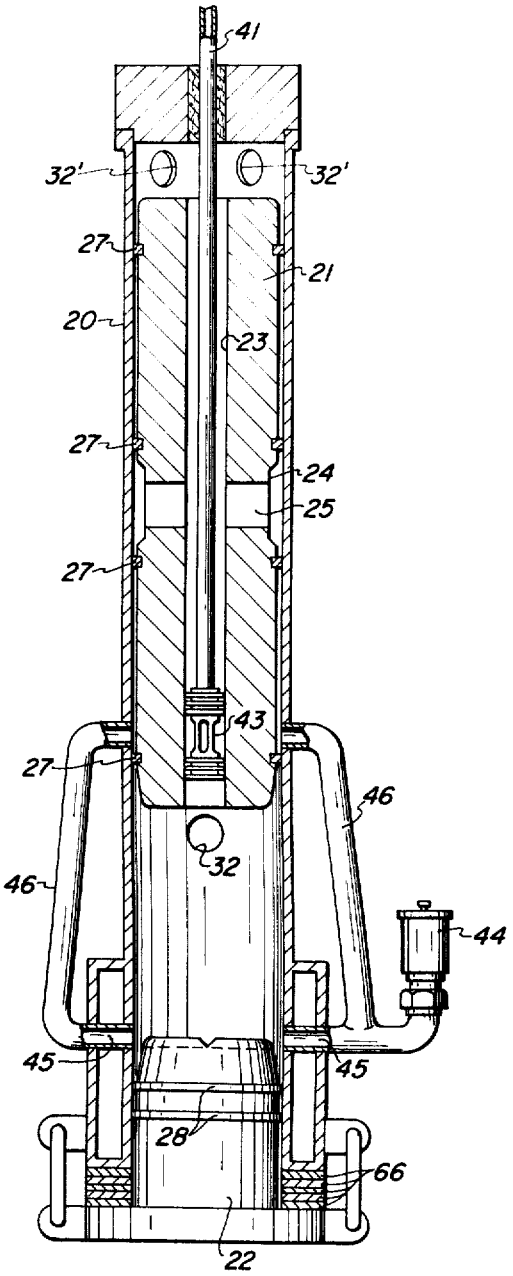

In FIGS. 17 and 18 there is illustrated a single-acting version of the hammer illustrated in FIGS. 9 and 10. Here, motive fluid is passed through tubular stem 41 and valve element 43 and then through motive fluid connections 45, 46 to expansion chamber 29 to raise the ram from the lower position, shown in FIG. 17, to the upper position, shown in FIG. 18. Upon opening of chamber 29 to atmosphere, through port 32, the ram will drop freely from the upper position to the lower position. Upward movement of the ram is facilitated by ports 32' which are open to the ambient atmosphere and relieve any back pressure in the upper portion of the cylinder as the ram rises. These same ports 32' will prevent vacuum buildup and consequent retardation of the ram during the downstroke thereof.

Figure 19:
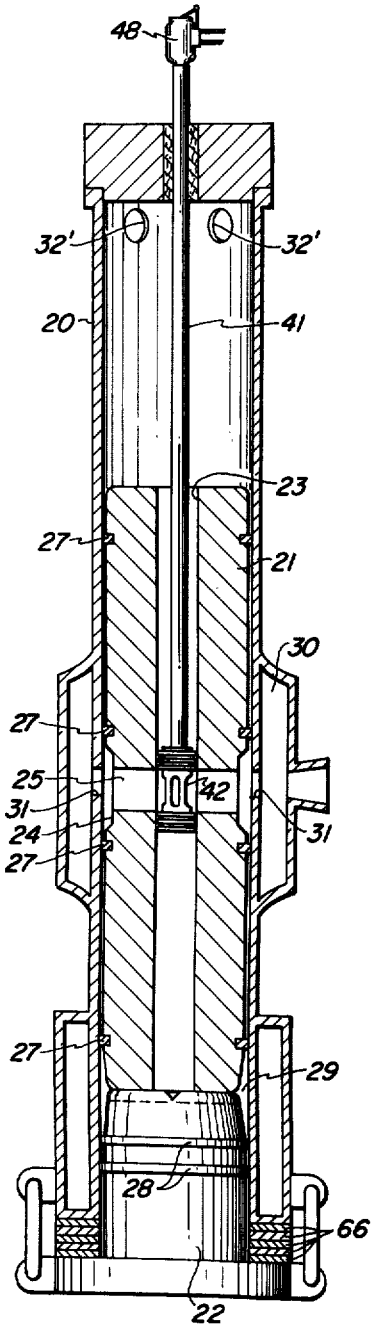
FIGS. 19 and 20 are longitudinal cross-sectional views of another single-acting pile hammer in which a choke control valve, similar to that of FIG. 11, is employed to cushion the drop of the ram.
Figure 21:
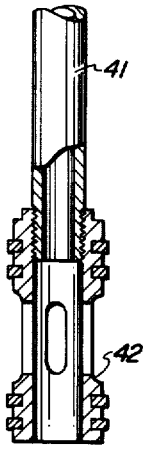
FIG. 21 is an enlarged fragmentary cross-sectional view of a valve element of the hammer of FIGS. 19 and 20.
Figure 20:
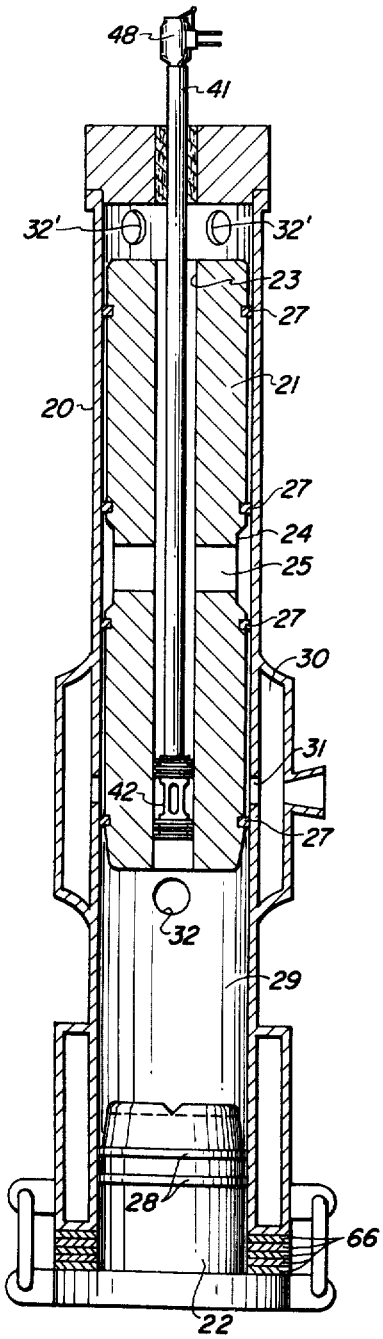

Turning now to FIGS. 19 through 21, another single-acting hammer is shown. Motive fluid is supplied from chest 30 and passes through valve element 42, carried by stem 41, to the expansion chamber 29 to lift ram 21 from the lower position, shown in FIG. 19, to the upper position, shown in FIG. 20. A back pressure valve 48, similar to that of FIG. 11, is affixed to the stem 41 and includes a choke for softening or cushioning the blow of the ram in the downward stroke, by virtue of the control of the back pressure which will build up beneath the ram during the downstroke. Alternately, a back pressure valve, similar to that of FIG. 8, can be placed in stem 41 in place of valve 48.

In all forms of the invention, ample clearance for the entering motive fluid is provided, assuring quick immediate action.

The lower face of the anvil is shown with cross V-grooves 62 (see FIG. 4A) providing instant access of entering live steam or compressed air to the lower lifting area of the ram.

By reversing the hammer, end for end, and providing pile attaching means, the hammer may be used as a pile extractor.

The choke added to the exhaust back pressure valve 48 in FIG. 11 is shown as a simple choke plate which can be closed by a compressed air or steam motor 49 to create back pressure in the lower cylinder for softening or cushioning the blow of the ram.

All forms of the hammer are of simple, sturdy, low-cost construction.

Clearance volume to provide room for air compressed ahead of the descending ram may be provided by closed end tubes connected with the expansion chamber as shown at 63 in FIG. 15 or by chest 64 surrounding the expansion chamber and open thereto by ports 65. No ports 65 are present in the hammer of FIGS. 19–21.

Rest position of the ram and start and finish of stroke may be governed to a desirable extent by the number of steel and shock absorbing spacing shims 66 used between the anvil and the end of the cylinder. No "cushion block" is required. The piston rings 27 located at opposite ends of annular groove 24 are spaced apart a sufficient distance to enable repositioning of the ram by the addition or subtraction of spacing shims 66 to vary the start and finish of the stroke of the ram without changing the mode of operation of the hammer. Thus, the spacing shims 66 provide means for selectively varying the location of the lower position of the ram relative to the cylinder to control cutoff, or duration of motive fluid inlet. The more spacing shims 66 inserted, the longer the duration of inlet, the greater is the amount of motive fluid energy introduced into the expansion chamber and the higher the ram will be lifted. Such a means for control is advantageous in changing from one motive fluid to another. That is, different inlet durations should be used with heated air at different temperatures, while a still different duration would be more appropriate for saturated steam.

The hammer forms a compact unit free of objectionable valve or other projections and may be operated underwater as well as on dry land.

The hammer may be made self-stopping by lowering the anvil below the point of registration of ram inlet slots with the cylinder inlet ports.

The controls illustrated enable the hammer to be adjusted to meet many different or changing operating conditions.

It is to be understood that the above detailed description of an embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. A power hammer comprising:

a normally upright cylinder having a top, an upper portion and a lower portion;

an anvil at the lower end of the cylinder, the anvil having an upper face;

a ram in said cylinder operating in cooperative relation with the anvil, said ram being movable longitudinally between a lower position, wherein the ram is against the anvil, and an upper position, wherein the ram is away from the anvil and adjacent the upper end of the cylinder;

the ram having an upper end and a lower end, an upper lateral surface adjacent the upper end and a lower lateral surface located intermediate the upper end and a lower lateral surface located intermediate the upper end and lower end of the ram;

a longitudinal passage in the ram passing through the upper end thereof and a lateral opening connecting the passage with the exterior of the ram below the lower lateral surface thereof;

a tube carrying a piston valve element positioned within the passage to register with the opening in the down position of the ram and enable communication between the interior of the tube and the lower portion of the cylinder at the lower lateral surface of the ram in the down position; and sealing means on said tube for sealing said opening from said passage until the ram is adjacent the upper position thereof, wherein the opening communicates with the upper portion of the cylinder at the upper surface of the ram, through said passage while, at the same time, connecting the passage with the exterior of the ram below the lower lateral surface thereof;

said upper surface of the ram having a larger area than the lower surface of the ram.

2. The invention of claim 1 wherein said sealing means include a sleeve and sealing rings on the tube.

3. The invention of claim 1 wherein the tube is mounted in the top of the cylinder.

4. The invention of claim 3 including a motive fluid chest at the top of the cylinder and wherein the tube communicates with the chest.

5. The invention of claim 1 wherein the ram includes an upper head portion and a lower striking portion, the head portion having a larger diameter than the striking portion.

6. The invention of claim 5 wherein the head portion and the striking portion are assembled from separate parts.

* * * * *